United States Patent [19]

Kamp

[11] Patent Number: 4,665,557

[45] Date of Patent: May 12, 1987

[54] MULTIPLE OMEGA CLOSURES

[75] Inventor: Ewald A. Kamp, Chicago, Ill.

[73] Assignee: First Brands Corporation, Danbury, Conn.

[21] Appl. No.: 887,917

[22] Filed: Jul. 22, 1986

[51] Int. Cl.[4] ..... B65D 33/24

[52] U.S. Cl. ..... 383/63; 383/65; 24/339; 24/399

[58] Field of Search ..... 383/63, 65, 68, 64; 24/204 C, 339, 399, 400, 406

[56] References Cited

U.S. PATENT DOCUMENTS

| | | | |
|---|---|---|---|
| 2,789,609 | 4/1957 | Post | 383/65 |
| 3,226,787 | 1/1966 | Ausnit | 383/65 |
| 3,535,746 | 10/1970 | Thomas | 24/30.5 |
| 3,679,511 | 7/1972 | Ausnit | 383/63 |
| 4,186,786 | 2/1980 | Kirkpatrick | 383/63 |
| 4,212,337 | 7/1980 | Kamp | 383/63 |
| 4,285,105 | 8/1981 | Kirkpatrick | 383/63 |
| 4,363,345 | 12/1982 | Scheibner | 383/63 |
| 4,561,108 | 12/1985 | Kamp | 383/65 |

*Primary Examiner*—Willis Little
*Attorney, Agent, or Firm*—Gary L. Wamer

[57] ABSTRACT

An interlocking closure fastening device comprising a first closure element having an omega-shaped profile portion, and a second complementary closure element having a plurality of omega-shaped profile portions spaced to interdigitate with the first closure element and occlude with the first closure element. The profile portion of the first closure element is made from a stiff resin material, and is attached to a base portion made from a flexible resin material. The second closure element is made from a stiff resin material. The base portions of the second closure element are spaced from each other and interconnected by a flexible connecting portion. The closure device is adapted for use with reclosable plastic freezer storage and cooking bags.

25 Claims, 6 Drawing Figures

FIG. 3
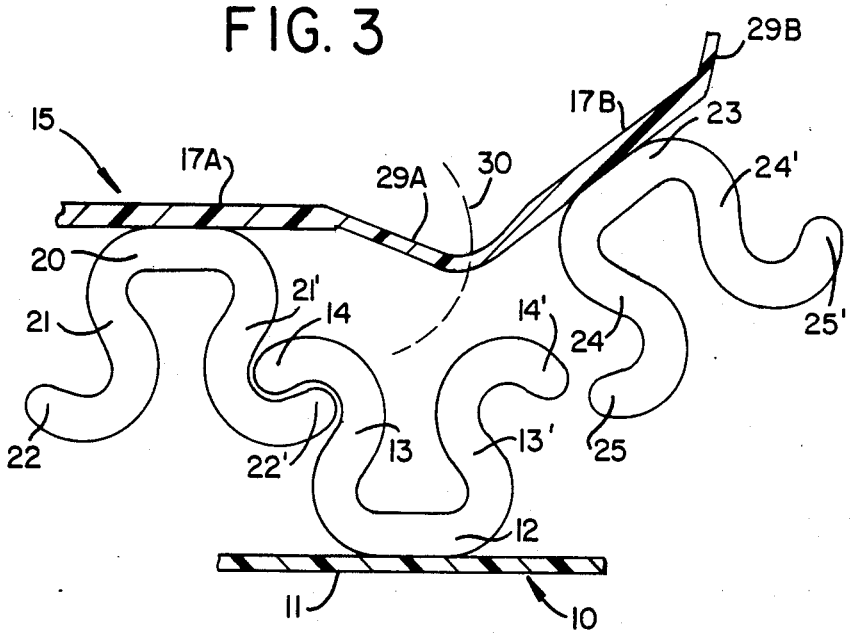
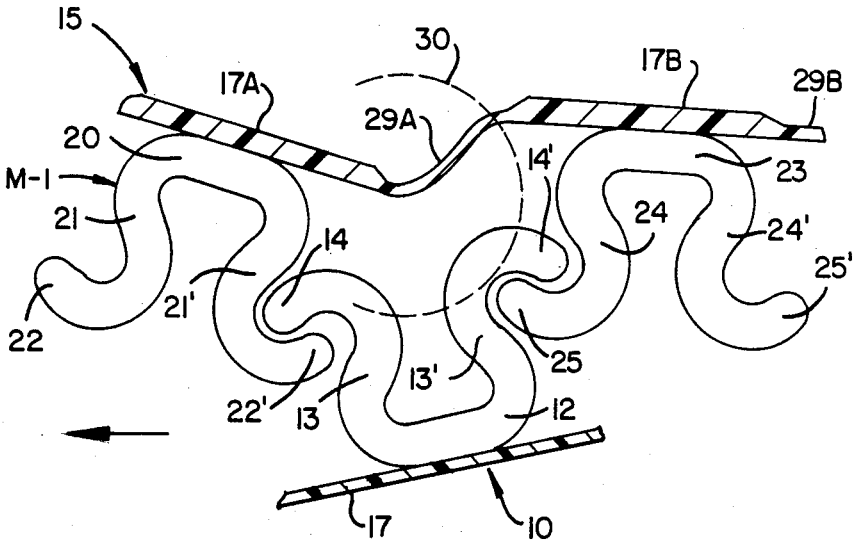
FIG. 4

MULTIPLE OMEGA CLOSURES

CROSS-REFERENCE TO RELATED APPLICATION

This application is related to copending application Ser. No. 774,997 filed Sept. 11, 1985, titled Trident Interlocking Closure Profile Configuration, commonly assigned to the present assignee.

FIELD OF THE INVENTION

This invention relates to an interlocking closure fastening device, and more particularly, to an interlocking closure fastening device comprising an omega-shaped closure element, and a complementary series of omega-shaped interdigitable closure elements as the second closure half. The closure device is particularly adapted for use with reclosable plastic storage bags.

BACKGROUND OF THE INVENTION

In general, closure fastening devices for use in connection with plastic bags and the like are known. Furthermore, manufacturing methods for closure fastening devices made of plastic material are generally well-known.

In operation, a closure fastening device for use in connection with a flexible container should be relatively easy to open from the outside, but relatively difficult to open from the inside. Generally, such a container can be used with its interior either under relatively high pressure or under relatively low pressure. The closure fastening device should provide a satisfactory seal for either condition.

Preferably, the closure fastening device should be suitable for economical manufacturing and should be relatively simple in design. In addition, the design should provide for variations in order to meet different needs. For example, it may be desirable to have a closure fastening device which is relatively difficult to open both from the inside and the outside. In general, the closure fastening device, however, should always be relatively easy to close.

In addition, when the closure fastening device is employed with a container, the container may be made from a thermoplastic material and the closure device and sidewalls of the container can be made integrally by extrusion as a unitary piece or can be made as separate components which are subsequently permanently connected together.

One prior art fastening device is disclosed in Thomas U.S. Pat. No. 3,535,746 comprising a generally omega-shaped bag fastener having extended legs and two outwardly curved arm portions. The fastener when placed about the neck of a bag is locked in place by twisting the legs into an intertwined engaged position. The fastener is made from a flexible resilient thermoplastic material such as polypropylene. However, the fastener of the '746 patent is not employed with a complementary fastener element.

Another prior art fastening device is disclosed by Kamp in U.S. Pat. No. 4,212,337. This device comprises a first U-shaped channel element including hook portions facing away from each other and a second U-shaped channel element including hook portions facing towards each other. The channel elements interlock by pressing the first channel element into the second channel element so that the hook portions engage each other at predetermined contact surfaces.

It should be appreciated that conventional thermoplastic interlocking closure fastening devices are made of deformable materials so as to employ the bending properties of the materials which form the bottom, leg, and hook portions, hereinafter referred to collectively as the "profile portions", of each closure element to occlude the elements to each other, and alternatively, to allow the elements to be separated as during their deocclusion. Thus, manipulation of such fastening devices requires the use of relatively soft, resilient resins since the closure elements have to be flexible to occlude or de-occlude.

One of the latest developments of plastic containers is a bag which can be used as a food storage container in a refrigerated or frozen condition as well as for heating and/or cooking food such as by placing the bag in hot water or in a microwave oven. When used in a microwave oven, it is not unusual for such bags to encounter temperatures of 260° F. to 300° F., for example, such as when cooking meats. Even during the boiling of foods, such as in a metal pot, temperatures higher than 212° F. are sometimes obtained above the water level such as near the rim of the pot necessitating better temperature resistance to softening or melting of the plastic bag than can be provided by the frequently used polyethylene resins. In order to overcome such problems at elevated temperatures, it is known that higher melting point resins may be employed which generally have higher stiffness moduli and also therefore resist softening or melting. However, when such higher stiffness moduli resins are employed as the materials of construction for the closure device, the closure device resists bending and deflection, which are the most frequently used means of occlusion and de-occlusion of interlocking closure devices made from flexible resins such as polyethylene.

Therefore, it would be highly desirable to obtain an interlocking closure device having relative ease of occlusion and de-occlusion, wherein the interlocking closure device, if so desired, is resistant to elevated temperature, the closure device may be manufactured with ample tolerance latitude, and wherein the operation of the closure elements is truly mechanical and not dependent upon the deflection characterized of the closure elements.

SUMMARY OF THE INVENTION

In accordance with this invention, there is provided an interlocking closure fastening device comprising a first closure element having an omega-shaped profile portion, and a second complementary closure element having a plurality of omega-shaped profile portions interconnected by hingable sections and spaced to interdigitate with said first closure element and provide occlusion with said first closure element. Generally speaking, the profile portion of the first closure element is made from a stiff resin material having a high flexural modulus, and is attached to a base portion which can be of relatively flexible or relatively stiff material. The profile portions of the second closure element are made from a stiff resin material having a high flexural modulus. The base portions of the second closure element are made from a stiff resin material having a high flexural modulus or else one of a thickness sufficient to be relatively stiff. These base portions are interconnected by a connecting portion which is more flexible than the base portions themselves. Occlusion and deocclusion of the closure elements is accomplished by causing the terminal portion of one closure element to engage or disengage with the terminal portion of the other closure element in hinge-like fashion.

By the term "omega-shaped" is meant a shape which is substantially the same as the last letter of the Greek alphabet. Elements which have an omega-shaped cross-section are ideally suited to fabrication by extrusion since they are free of any sharp corners or other complexities of cross-section.

By the term "high flexural modulus" is meant a flexural modulus which is at least about 150,000 psi. The term "relatively stiff" means having a flexural modulus of at least about 110,000 psi or higher. The term "relatively flexible" means having a flexural modulus not greater than about 60,000 psi.

It is understood that, although the closure fastening devices of the invention are particularly adapted for use in applications which involve exposure to elevated temperatures, they can be employed in any other applications for which closure fastening devices are conventionally employed. Thus, the closure fastening devices of the invention are not intended to be regarded as useful only when elevated temperatures are a concern but clearly have much wider application as will be readily apparent to one skilled in the art.

BRIEF DESCRIPTION OF THE DRAWINGS

FIG. 3 is a cross-sectional view of the closure fastening device of this invention in essentially a completely deoccluded position.

FIG. 4 is a cross-sectional view of the closure fastening device of this invention under pressure from the interior of a container.

DETAILED DESCRIPTION OF THE PREFERRED EMBODIMENTS

The foregoing criteria for a closure fastening device are met by the present invention wherein the fastening device comprises a first closure element having a general omega shape and comprising a base portion, and a profile portion attached to the base portion, said base portion being generally straight, and said profile portion comprising two spaced-apart, inwardly curved arm portions terminating in two outwardly facing, curvilinear hook portions. The profile portion of the first closure element is made from a stiff resin material having a high flexural modulus. The base portion of the first closure element is made from a resin material having some resistance to bending. Said base portion of the first closure element can be connected to or integrally formed on a sidewall of a pouch or container.

The closure fastening device of this invention also comprises a second closure element comprising a plurality of omega-shaped profile portions which are attached to base portions. The base portions are generally straight and the profile portions each comprise two spaced-apart, inwardly curved arm portions terminating in two outwardly facing, curvilinear hook portions. The base portions of the second closure element are attached to or integrally formed on the sidewall of a pouch or container. The plurality of profile portions of the second closure element are spaced from each other to interdigitate with the first closure element and occlude with the first closure element. The profile portions and base portions of the second closure element are preferably made from stiff resin materials having a high flexural modulus but the most desirable material for use in any given instance is a matter of choice depending on the application for which the closure element is to be employed. The base portions of the second closure element are interconnected by pliable sections. These pliable sections can be formed from a different resin material which is more flexible than that employed to form the base portions. Alternatively, and preferably, the pliable sections are formed from the same material as the base portions but are of a reduced thickness compared with that of said base portions so as to render the interconnecting sections sufficiently thin to be capable of being flexed.

These thinner, pliable tape sections enable articulation of the closure bases and function as a hinge to allow rotation of the profile portions of the second closure element with respect to the profile portion of the first closure element. The first closure element and the second closure element thus engage and disengage each other by means of a hinging type of occlusion and deocclusion as opposed to the bending and deflection type of occlusion and deocclusion hitherto generally employed in the art.

For a fuller understanding of the nature of the invention, reference should be had to the following detailed description, taken in conjunction with the accompanying drawings.

Figure 1:
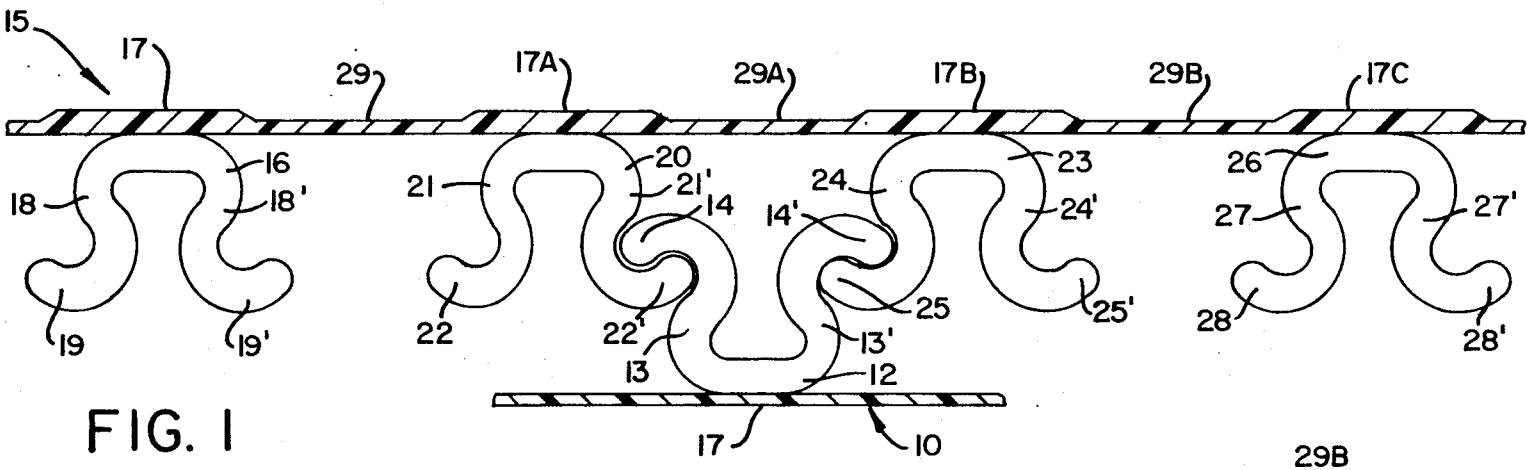
FIG. 1 is a cross-sectional view of the closure fastening device of this invention in an occluded position.

FIG. 1 is a cross-sectional view of the closure fastening device of this invention in an occluded position. As shown in FIG. 1, the first closure element 10 having a profile of a general omega shape is connected to a base 11 for use in attachment to a thermoplastic film, or is integrally formed on such a film. Closure element 10 has a bottom portion 12 of the profile which is typically straight, and extending from bottom portion 12 is a portion which comprises two inwardly curved arm portions 13 and 13' which terminate in two outwardly curving hook portions 14 and 14', respectively.

The second closure element 15 comprises a plurality of omega-shaped profile portions each having a bottom portion which is typically straight. Closure element 15 may comprise a minimum of at least two omega-shaped profile portions. For purpose of illustration, in the particular embodiment of FIG. 1, closure element 15 actually comprises four omega-shaped profile portions. Thus, reading from the left-hand end of closure element 15, the first profile portion has a bottom portion 16 which is connected to a ridged or thickened portion of base 17. Extending from bottom portion 16 is a profile portion which comprises two inwardly curved arm portions 18 and 18' which terminate in two outwardly curving hook portions 19 and 19'. Similarly, the second profile portion of element 15 has a bottom portion 20 connected to a ridged or thickened portion 17-A of base 17. Extending from bottom portion 20 is a profile portion which comprises two inwardly curved arm portions 21 and 21' which terminate in two outwardly curving hook portions 22 and 22'. The third profile portion of element 15 has a bottom portion 23 connected to a ridged or thickened portion 17-B of base 17. Extending from bottom portion 23 is a profile portion which comprises two inwardly curved arm portions 24 and 24' which terminate in two outwardly curving hook portions 25 and 25'. The fourth profile portion of element 15 has a bottom portion 26 connected to a ridged or thickened portion 17-C of base 17. Extending from bottom portion 26 is a profile portion comprising two inwardly curved arm portions 27 and 27' which terminate in two outwardly curving hook portions 28 and 28'. Thickened base portions 17, 17-A, 17-B and 17-C are interconnected by thinner, pliable closure sections 29, 29-A, and 29-B, respectively.

As shown in FIG. 1, when the closure fastening device of this invention is in an occluded position, hook portions 14 and 14' of closure element 10 may be interlocked with hook portions 22' and 25 of the second and third profile portions of closure element 15. It can also be seen from FIG. 1 and hook portion 25 of the third profile portion of closure element 15 is adapted to engage in a hinging contact with hook portion 14' of closure element 10. When the closure fastening device is connected to a pouch or container, arm portion 27' and hook portion 28' are the ones positioned closest to the mouth or outside portion of the container, and arm portion 18 and hook portion 19 are the ones positioned closest to the interior or inside portion of the container.

Figure 2:
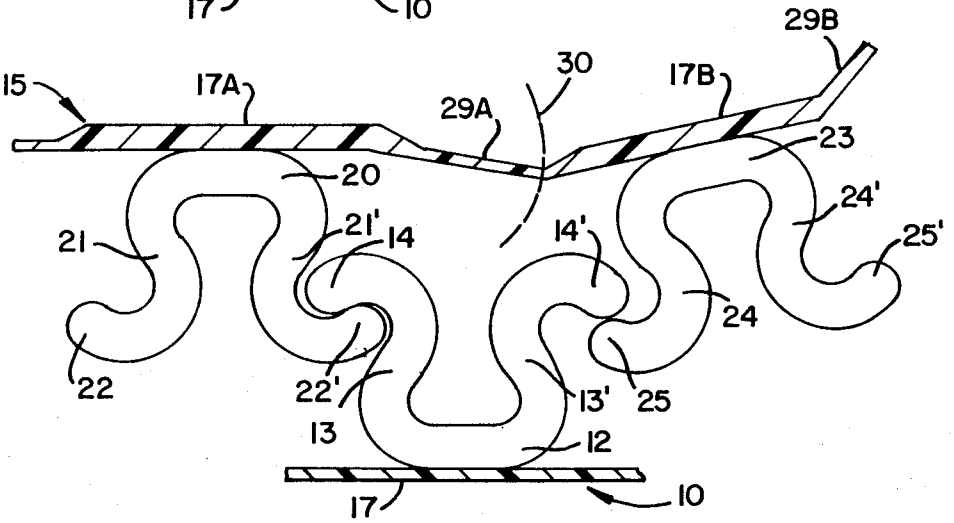
FIG. 2 is a partial cross-sectional view of the closure fastening device of this invention in a partially deoccluded position.

FIG. 2 is a partial cross-sectional view of the closure fastening device of this invention in a partially deoccluded position. For deocclusion of the closure fastening device, the outside or mouth portions of the container are separated and pulled apart by the user. When this operation is performed, an external release force is exerted on the closure fastening device at base 11 and base 17. Since the profile portions of closure element 10 and the profile portions of closure element 15 are rigid, being made from stiff resin materials having a high flexural modulus, they cannot be deoccluded by bending the profile portions as with conventional interlocking closure fastening devices. However, the special construction of base 17 having thinner, pliable sections 29, 29-A, and 29-B permits bending of said base 17 at pliable sections 29, 29-A, and 29-B to act as a hinge pin and allow the ridged or thickened portions of base 17 to articulate with respect to each other. As shown in FIG. 2, during deocclusion the left end of base segment 17-B moves downwardly, i.e., toward closure element 10, within the constraints of arc 30 when segment 29-B is employed to rotate bottom portion 23 of said third profile section and cause hook portion 25 to begin to disengage from hook portion 14' of closure element 10.

FIG. 3 is a partial cross-sectional view of the closure fastening device shown in FIGS. 1 and 2 in essentially a completely deoccluded position. In order to obtain full release of hook portion 25 of the third profile section of closure element 15 from hook portion 14' of closure element 10, the external release force on base segment 29-B is continued causing the interior end of base segment 17-B to move further downward through arc 30 and obtain release of said hook portion 25 from said hook portion 14'. The aforementioned parts of the fastening device are rotated over an arc of between about 30° and about 70°. On disengagement of hook portion 25 from hook portion 14', base segment 17-B may be moved upward along arc 30 to preclude re-engagement of hook portion 25 with hook portion 14', and base segment 17-A is moved away from (to the left in FIG. 3) closure base 11, thus completing the deocclusion of closure element 10 and closure element 15.

It should be noted at this point that the actions discussed and illustrated for deocclusion apply in the reverse order for occlusion, which re-engages the hook elements forming the hinge structure, and, by further movement, re-establishes the occlusion of the closure elements. From the foregoing, it can be readily understood that the closure fastening device of this invention is truly a kinematic closure device, i.e., one which depends upon articulation of its closure elements rather than upon stresses or bending of its parts to produce occlusion and/or deocclusion of the closure device.

FIG. 4 is a cross-sectional view of the closure fastening device shown in FIGS. 1 and 2 under pressure from the interior of a container. The interior portion of the container is generally indicated by the arrow in FIG. 4. FIG. 4 illustrates how resistance to opening of the closure fastening device is generated by internal pressure in the container, for example, such as when the container has been filled with contents. It can be seen from FIG. 4 that simultaneous deflection of the container walls from the inside as at base section 11 and base section 17-A makes unlatching or deocclusion of closure element 10 and closure element 15 difficult because rotation of closure element 10 draws down the interior profile portion (designated M-1) of closure element 15 thus preventing deocclusion.

Figure 5:
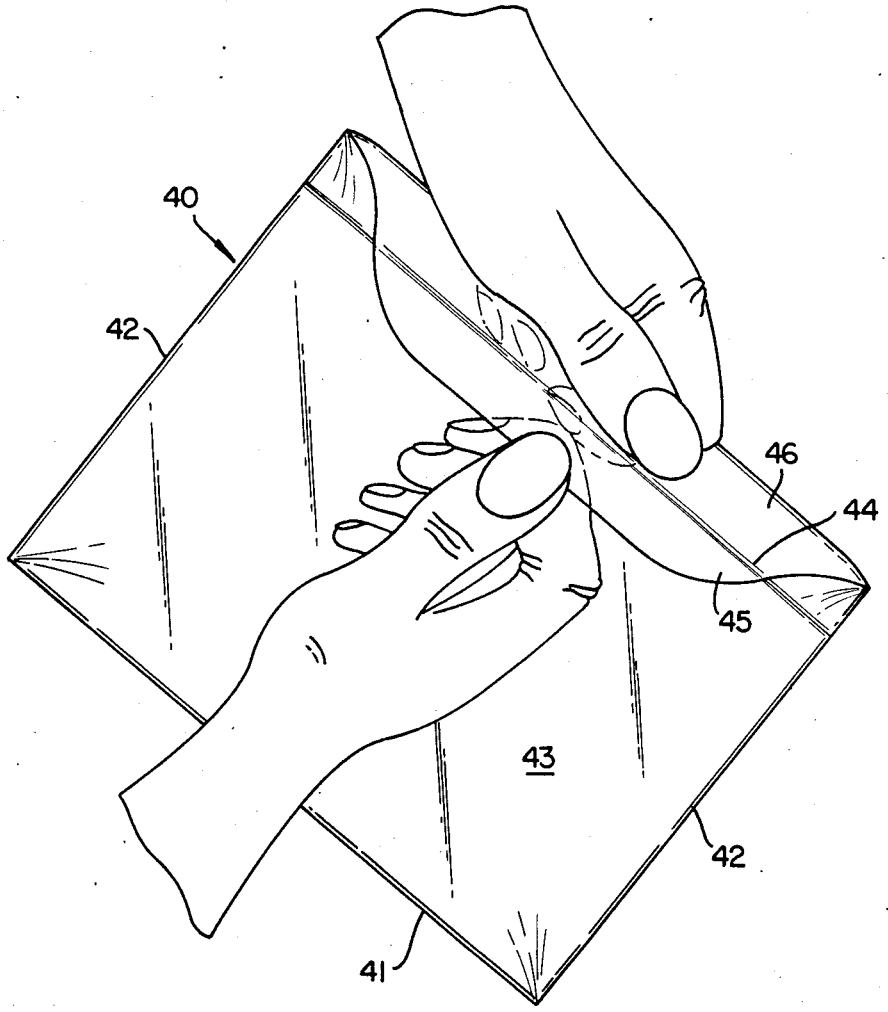
FIG. 5 is a perspective view of a container in accordance with one embodiment of this invention.

FIG. 5 is a perspective view of a container 40 in accordance with one embodiment of this invention formed from a thin thermoplastic multilayer film which has been folded at the bottom portion 41, and which has been heat-sealed along the side edges 42. Sidewalls 43 extend beyond the closure fastening device 44 of this invention to provide mouth portions 45 and 46 to simplify the opening of the closure device 44 such as by pulling mouth portion 46 away from mouth portion 45 in the direction of the arrow shown in FIG. 4. In this embodiment, the closure fastening device would have the structure shown in FIG. 2 and FIG. 3.

Figure 6:
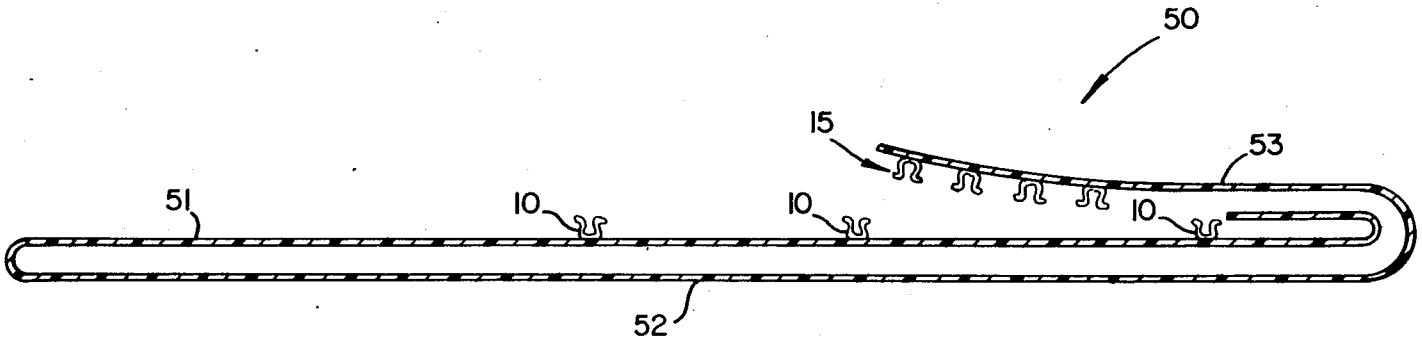
FIG. 6 is a cross-sectional view of a variable volume container in accordance with another embodiment of this invention.

FIG. 6 is a cross-sectional view of a variable volume pouch or container in accordance with another embodiment of this invention. The variable volume container 50 has a front wall 51 and a rear wall 52. A flap 53 extends from the rear wall 52 over part of front wall 51. Flap 53 is provided with the second closure element 15 shown in FIG. 1, and front wall 51 is provided with the first closure element 10 shown in FIG. 1. Front wall 51 may also be provided with a plurality of first closure elements 10 as shown in FIG. 6.

The closure fastening device of the instant invention may be made from a thermoplastic material selected from the group consisting of polyolefins such as polyethylene, polypropylene, and polybutene; polyamides such as nylon; or other thermoplastic materials, including combinations thereof. The closure fastening device is preferably made from a thermoplastic resin composition comprising polypropylene, or a mixture of polypropylene resin and ethylene-propylene-diene monomer elastomer, or a mixture of polypropylene resin and ethylene-propylene copolymer elastomer. The choice of resin or resins used in any particular instance depends upon the end use of the closure device and container in which it is incorporated. For food storage bags intended for freezer storage followed by cooking using boiling water or microwave oven, polypropylene or mixtures of polypropylene and ethylene-propylene copolymers may be used. For higher temperature use (such as heating in a regular oven) nylons, polycarbonates, polysulfones and the like would be more appropriate.

The dimensions of the closure fastening device may vary in accordance with intended use and depending upon the materials used in their manufacture because of the variations in physical properties, such as flexural moduli.

In preferred practice, the closure tapes and the closure elements are coextruded, however, the closure bases and the closure elements may be extruded separately and then attached to each other by conventional means.

The closure fastening device of this invention can be manufactured by known methods such as by extrusion, by the use of molds or other known methods of producing such devices. The closure fastening device can be manufactured as a strip for later attachment to a film or it can be manufactured integral with the film.

The closure elements can be connected with a container or to a film to be formed into a container by the use of many known methods. For example, a thermoelectric device can be applied to a film opposite a closure element to cause a transfer of heat through the film to produce melting at the interface of the film and the closure element. After cooling, the interface region joins the film and the closure element.

The thermoelectric device can be heated by rotary discs, or resistance heated wires, or traveling heater bands, or the like.

The connection between the film and the closure element can also be established by the use of hot melt adhesives, or heated jets of air to the interface, or ultrasonic heating, or other known methods.

Generally, the present closure fastening device can be made from a heat sealable material and then attached to a heat sealable film so that a container can be formed economically by heat sealing surfaces to form the container.

The instant closure fastening device provides many advantages for consumers when used on containers. For instance, it is easy to close a container because the closure elements rotate or twist with respect to each other from the de-occluded to the occluded position with little effort in spite of the high flexural moduli of the temperature resistant resins used. The action contrasts with prior art structures such as arrow-head types of closures where, in the female elements, the hooked sides have to be bent or otherwise distorted for occlusion or de-occlusion. In a prior art channel closure, a base portion has to be bent to accomplish occlusion or de-occlusion. And still another structure made very stiff, requires longitudinal displacement to a non-hooked end before the first or male and second or female closure elements can be pried apart by elastic bending of portions of each element.

Moreover, the closure fastening device of this invention provides, in combination, novel functions and structures wherein the closure device is easy to occlude and de-occlude even though it is made from high modulus; i.e., stiff resins; it can be made resistant to high and low temperature conditions; and it has a "preferential opening" characteristic whereby the closure device is easily opening from the outside of a container, but strongly resists opening from the inside of a container.

Generally, the closure device of the invention can be manufactured in a variety of forms to suit the intended use. In addition to the embodiments shown herein, the elements can be positioned on opposite sides of a film. Such an embodiment would be suited for enwrapping an object or a collection of objects such as wires. Generally, the elements on a film should be parallel to each other but this would depend on the intended use. In addition, it is preferred that the closure elements be colored a different color to more easily verify when they are properly occluded.

Although certain embodiments of the present invention have been described and set forth in detail, it should be further understood that other embodiments of the invention are contemplated by way of changes, modifications and variations to the description without departing from the scope and spirit of the invention as set forth in the appended claims. Such changes, modifications and variations are within the scope of this invention.

I claim:

1. An interlocking closure fastening device comprising a first closure element having an omega-shaped profile portion, and a second complementary closure element comprising a plurality of omega-shaped profile portions interconnected by hingable sections and spaced to interdigitate with said first closure element, said first closure element and said second closure element forming an interlocked closure fastening device when they are occluded together.

2. An interlocking closure fastening device in accordance with claim 1 wherein the omega-shaped profile portion of said first closure element comprises a generally straight bottom portion fastened to a base and having two spaced-apart arm portions extending outwardly from opposite ends of said bottom portion, said arm portions being curved inwardly towards each other in the section closest to said bottom portion and thereafter curving outwardly and terminating in outwardly facing curvilinear hook portions.

3. An interlocking closure fastening device in accordance with claim 1 wherein said profile portion of said first closure element is made from a stiff resin material having a high flexural modulus.

4. An interlocking closure fastening device in accordance with claim 2 wherein said base portion of said first closure element is made from a flexible resin material having a low flexural modulus.

5. An interlocking closure fastening device in accordance with claim 1 wherein said profile portion and said base portion of said first closure element are both made from the same relatively stiff resin material.

6. An interlocking closure fastening device in accordance with claim 1 wherein the omega-shaped profile portions of said second closure element each comprise a generally straight bottom portion fastened to a base and having two spaced-apart arm portions extending outwardly from opposite ends of said bottom portion, said arm portions being curved inwardly towards each other in the section closest to said bottom portion and thereafter curving outwardly and terminating in outwardly facing curvilinear hook portions.

7. An interlocking closure fastening device in accordance with claim 1 wherein said profile portions of said second closure element are made from a stiff resin material having a high flexural modulus.

8. An interlocking closure fastening device in accordance with claim 6 wherein said base portions of said second closure element are made from a stiff resin material having a high flexural modulus.

9. An interlocking closure fastening device in accordance with claim 6 wherein said base portions, to which each of said plurality of omega-shaped profile portions in said second closure element are attached, form part of a sheet member on which said profile portions are disposed in parallel relationship.

10. An interlocking closure fastening device in accordance with claim 9 wherein said sheet member is fabricated from a resin of high flexural modulus the portions of said sheet member which form said base portions being relatively stiff and the portions of said sheet member which interconnect said base portions being thinner than said base portions and relatively pliable.

11. An interlocking closure fastening device in accordance with claim 6 wherein said base portions of said second closure element are interconnected by thin, pliable sections fabricated from a different resin material than said base portions.

12. An interlocking closure fastening device comprising a first closure element having an omega-shaped profile portion and a second complementary closure element comprising a plurality of omega-shaped profile portions, each of said omega-shaped profile portions on said second closure element being of substantially the same dimensions and each comprising a generally straight bottom portion fastened to a base portion and having two spaced-apart arm portions extending outwardly from opposite ends of said bottom portion, said arm portions being curved inwardly towards each other in the section closest to said bottom portion and thereafter curving outwardly and terminating in outwardly facing curvilinear hook portions, each of the base portions to which the omega-shaped profile portions of said second closure element are fastened being interconnected by thin pliable sections and being spaced apart from its neighbors a distance such as to permit the hook portions of said profile section of said first closure element to be brought into interlocking engagement with corresponding base portions of two adjoining profile portions of said second closure element by appropriate articulation of the base portion of one of said adjoining profile portions about the other to widen the gap between said corresponding hook portions thereof sufficiently to permit introduction therebetween of the hook portions of said profile portion of said first closure element.

13. An interlocking closure fastening device in accordance with claim 1 attached to a container.

14. A container comprising two sidewalls and an interlocking fastening device, said fastening device comprising a first closure element having an omega-shaped profile portion, and a second complementary closure element comprising a plurality of omega-shaped profile portions interconnected by hingable sections and spaced to interdigitate with said first closure element, said first closure element and said second closure element forming an interlocked closure fastening device when they are occluded together.

15. A container in accordance with claim 14 wherein the omega-shaped profile portion of said first closure element comprises a generally straight bottom portion fastened to a base and having two spaced-apart arm portions extending outwardly from opposite ends of said bottom portion, said arm portions being curved inwardly towards each other in the section closest to said bottom portion and thereafter curving outwardly and terminating in outwardly facing curvilinear hook portions.

16. A container in accordance with claim 14 wherein said profile portion of said first closure element is made from a stiff resin material having a high flexural modulus.

17. A container in accordance with claim 15 wherein said base portion of said first closure element is made from a flexible resin material having a low flexural modulus.

18. A container in accordance with claim 14 wherein said profile portion and said base portion of said first closure element are both made from the same relatively stiff resin material.

19. A container in accordance with claim 14 wherein the omega-shaped profile portions of said second closure element each comprise a generally straight bottom portion fastened to a base and having two spaced-apart arm portions extending outwardly from opposite ends of said bottom portion, said arm portions being curved inwardly towards each other in the section closest to said bottom portion and thereafter curving outwardly and terminating in outwardly facing curvilinear hook portions.

20. A container in accordance with claim 14 wherein said profile portions of said second closure element are made from a stiff resin material having a high flexural modulus.

21. A container in accordance with claim 19 wherein said base portions of said second closure element are made from a stiff resin material having a high flexural modulus.

22. A container in accordance with claim 14 wherein said profile portion and said base portion of said second closure element are both made from the same relatively stiff resin material.

23. A container in accordance with claim 19 wherein said base portions of said second closure element are interconnected by thin, pliable closure tape sections.

24. A container in accordance with claim 14 wherein said first closure element and said second closure element are made from a thermoplastic resin composition selected from the group consisting of polypropylene, a mixture of polypropylene and ethylene-propylene-diene monomer elastomer, and a mixture of polypropylene and ethylene-propylene copolymer elastomer.

25. A container comprising two sidewalls and an interlocking fastening device, said fastening device comprising a first closure element having an omega-shaped profile portion and a second complementary closure element comprising a plurality of omega-shaped profile portions, each of said omega-shaped profile portions of second closure element comprising a generally straight bottom portion fastened to a base portion and having two spaced-apart arm portions extending outwardly from opposite ends of said bottom portion, said arm portions being curved inwardly towards each other in the section closest to said bottom portion and thereafter curving outwardly and terminating in outwardly facing curvilinear hook portions, each of the base portions to which the omega-shaped profile portions of said second closure element are fastened being interconnected by thin pliable sections and being spaced apart from its neighbors a distance such as to permit the hook portions of said profile section of said first closure element to be brought into interlocking engagement with corresponding base portions of two adjoining profile portions of said second closure element by appropriate articulation of the base portion of one of said adjoining profile portions about the other to widen the gap between said corresponding hook portions thereof sufficiently to permit introduction therebetween of the hook portions of said profile portion of said first closure element.

* * * * *